US011787668B2

(12) United States Patent
Kanda et al.

(10) Patent No.: US 11,787,668 B2
(45) Date of Patent: Oct. 17, 2023

(54) CRANE

(71) Applicant: TADANO LTD., Kagawa (JP)

(72) Inventors: Shinsuke Kanda, Kagawa (JP); Kazuma Mizuki, Kagawa (JP)

(73) Assignee: TADANO LTD., Kagawa (JP)

( * ) Notice: Subject to any disclaimer, the term of this patent is extended or adjusted under 35 U.S.C. 154(b) by 687 days.

(21) Appl. No.: 16/978,990

(22) PCT Filed: Mar. 15, 2019

(86) PCT No.: PCT/JP2019/010990
§ 371 (c)(1),
(2) Date: Sep. 8, 2020

(87) PCT Pub. No.: WO2019/177164
PCT Pub. Date: Sep. 19, 2019

(65) Prior Publication Data

US 2021/0371255 A1 Dec. 2, 2021

(30) Foreign Application Priority Data

Mar. 16, 2018 (JP) ..... 2018-050258

(51) Int. Cl.
*B66C 13/30* (2006.01)
*B66C 13/06* (2006.01)
*B66C 23/42* (2006.01)

(52) U.S. Cl.
CPC ..... *B66C 13/30* (2013.01); *B66C 13/063* (2013.01); *B66C 23/42* (2013.01)

(58) Field of Classification Search
None
See application file for complete search history.

(56) References Cited

U.S. PATENT DOCUMENTS 5,908,122 A * 6/1999 Robinett ..... B66C 13/063 901/17
2008/0275610 A1 11/2008 Terashima et al.
(Continued)

FOREIGN PATENT DOCUMENTS

WO WO 2005/012155 A1 2/2005

OTHER PUBLICATIONS

Masoud et al., "A hybrid command-shaper for double-pendulum overhead cranes", Journal of Vibration and Control, vol. 20, Issue 1, 2014, pp. 24-37 (Year: 2014).*
(Continued)

*Primary Examiner* — Tamara L Weber
(74) *Attorney, Agent, or Firm* — Paratus Law Group, PLLC

(57) ABSTRACT

This crane is provided with: a operable function unit; an operation unit; an actuator; a generation unit which generates a first control signal for the actuator on the basis of an operation input; a plurality of wire ropes; a plurality of hooks suspended from a leading end section of a boom by the plurality of wire ropes, respectively; a hook detection unit which detects, from among the plurality of hooks, an unused hook suspending no load; a calculation unit which calculates a resonance frequency for a wire rope, among the plurality of wire ropes, that suspends the detected unused hook; a filter unit which generates a filter on the basis of the resonance frequency and generates a second control signal by filtering the first control signal using the filter; and a control unit which controls the actuator on the basis of the second control signal.

10 Claims, 9 Drawing Sheets

(56) References Cited

U.S. PATENT DOCUMENTS

| | | | | |
|---|---|---|---|---|
| 2009/0194498 | A1* | 8/2009 | Singhose | B66C 13/063 212/275 |
| 2018/0346294 | A1* | 12/2018 | Shely | B66C 23/905 |

OTHER PUBLICATIONS

Alhazza et al., "An Iterative Learning Control Technique for Point-to-Point Maneuvers Applied on an Overhead Crane", Hindawi Publishing Corporation, Shock and Vibration, 2014, pp. 1-11 (Year: 2014).*

May 21, 2019, International Search Report issued for related PCT application No. PCT/JP2019/010990.

May 21, 2019, International Search Opinion issued for related PCT application No. PCT/JP2019/010990.

* cited by examiner

CRANE

CROSS REFERENCE TO PRIOR APPLICATION

This application is a National Stage Patent Application of PCT International Patent Application No. PCT/JP2019/010990 (filed on Mar. 15, 2019) under 35 U.S.C. § 371, which claims priority to Japanese Patent Application No. 2018-050258 (filed on Mar. 16, 2018), which are all hereby incorporated by reference in their entirety.

TECHNICAL FIELD

The present invention relates to a crane.

BACKGROUND ART

In the related art, in a crane, a load being transported is vibrating. As such a vibration, vibration of a simple pendulum having a load suspended by a leading end of the a wire rope as a mass point or a double pendulum having a hook portion as a support point occurs with an acceleration to be applied during transportation as a motive force.

Alternatively, vibration due to bending of a structure constituting a crane such as a boom and a wire rope occurs in a load transported by the crane including the boom is addition to the vibration due to the simple pendulum or the double pendulum.

The load suspended by the wire rope vibrates at a resonance frequency of the simple pendulum or the double pendulum, and is transported while vibrating at a natural frequency in a derricking direction of the boom and a natural frequency in a slewing direction and/or a natural frequency during expansion and contraction vibration due to the expansion of the wire rope.

In such a crane, an operator needs to perform an operation of canceling the vibration of the load by slewing or derricking the boom by a manual operation of an operation tool in order to stably lower the load at a predetermined position. Thus, transportation efficiency of the crane is affected by a magnitude of the vibration generated during the transportation and a skill level of the crane operator.

Accordingly, there is known a crane that suppresses the vibration of the load by attenuating a frequency component of a resonance frequency of the load from a transportation command (control signal) an actuator of the crane and improves the transfer efficiency (see, for example, Patent Literature 1).

The crane device described in Patent Literature 1 calculates the resonance frequency from a rope length (suspension length) which is a distance from a rotation center of the vibration of the wire rope to a center of gravity of the load. That is, the crane device calculates the resonance frequency for the hook (used hook) that suspends the load. The crane device generates a filter control signal by removing a component near the resonance frequency from the control signal by the filter unit.

The aforementioned crane device suppresses swing of the load by controlling an operation of the boom based on the filter control signal during the transportation of the load.

CITATION LIST

Patent Literature

Patent Literature 1: WO2005/012155A

SUMMARY OF THE INVENTION

Problems to be Solved by the Invention

Incidentally, in the case of the crane described in Patent Literature 1, there is a possibility that an unused hook comes into contact with the wire rope and/or the boom that suspends the used hook due to the vibration of the unused hook that does not suspend the load during the transportation of the load.

An object of the present invention is to provide a crane that can reduce vibration of an unused hook during transportation.

Solutions to Problems

An aspect of a crane according to the present invention includes a operable function unit including at least a boom, an operation unit that receives an operation input for operating the operable function unit, an actuator that drives the operable function unit, a generation unit that generates a first control signal of the actuator based on the operation input, a plurality of wire ropes, a plurality of hooks that is suspended from a leading end section of the boom by the plurality of wire ropes, respectively, a hook detection unit that detects an unused hook which does not suspend a load among the plurality of hooks, a calculation unit that calculates a resonance frequency for the wire rope suspending the detected unused hook among the plurality of wire ropes, a filter unit that generates a filter based on the resonance frequency, and generates a second control signal by filtering the first control signal using the filter, and a control unit that controls the actuator based on the second control signal.

Effects of the Invention

According to the present invention, vibration of an unused hook can be reduced during transportation.

DESCRIPTION OF EMBODIMENTS

Hereinafter, a crane 1 according to a first embodiment of the present invention will be described with reference to FIGS. 1 and 2. In the present embodiment, the crane is a mobile crane (rough-terrain crane). However, the crane may be various cranes such as a truck crane.

Figure 1:
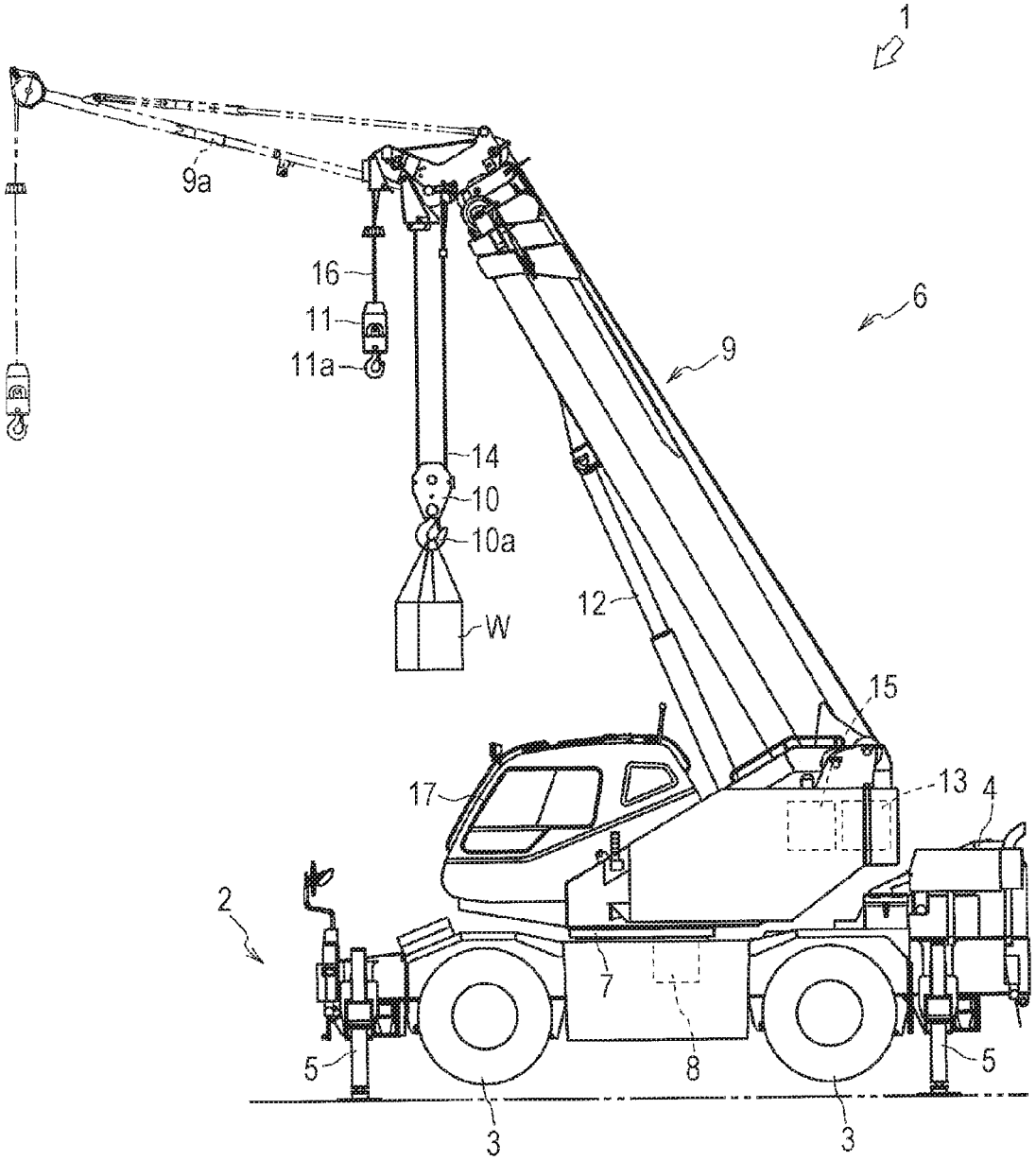
FIG. 1 is a side view illustrating an overall configuration of a crane.

As illustrated in FIG. 1, the crane 1 is a mobile crane that can move to an unspecified place. The crane 1 has a vehicle 2 and a crane device 6.

The vehicle 2 transports the crane device 6. The vehicle 2 has a plurality of wheels 3 and runs with an engine 4 as a power source. The vehicle 2 has an outrigger 5. The outrigger 5 has an overhanging beam and a jack cylinder. The overhanging beam can be expanded and contracted in a width direction of the vehicle 2 by hydraulic pressure.

The jack cylinder is fixed to a leading end section of the overhanging beam, and can be expanded and contracted in a direction perpendicular to the ground. The vehicle 2 can widen a workable range of the crane 1 by expanding and contracting the outrigger 5 in the width direction of the vehicle 2 and grounding the jack cylinder.

The crane device 6 lifts a load W with a wire rope. The crane device 6 includes a slewing base 7, a boom 9, a jib 9*a*, a main hook block 10, a sub hook block 11, a derricking hydraulic cylinder 12, a main winch 13, a main wire rope 14, a sub winch 15, a sub wire rope 16, and, a cabin 17.

The slewing base 7 supports the crane device 6 such that the crane device 6 can slew with respect to the vehicle 2. The slewing base 7 is provided on a frame of the vehicle 2 via an annular bearing. The slewing base 7 rotates about a center of the annular bearing. The slewing base 7 has a hydraulic type slewing hydraulic motor 8. The slewing base 7 slews in a first direction or a second direction by the slewing hydraulic motor 8. The hydraulic motor and the hydraulic cylinder that drive the boom 9 correspond to an example of an actuator. Specifically, the slewing hydraulic motor 8 corresponds to an example of an actuator.

The slewing hydraulic motor 8 is rotationally operated by a slewing valve 31 (see FIG. 2) that is an electromagnetic proportional switching valve. The slewing valve 31 can control a flow rate of hydraulic oil to be supplied to the slewing hydraulic motor 8 to any flow rate. That is, the slewing base 7 is controlled to any slewing speed via the slewing hydraulic motor 8 that is rotationally operated by the slewing valve 31. The slewing base 7 has a slewing sensor 25 (see FIG. 2) that detects a slewing position (angle) and a slewing speed of the slewing base 7.

The boom 9 supports the wire rope in a state in which the load W can be lifted. The boom 9 is constituted by a plurality of boom members. The boom 9 is expanded and contracted in an axial direction by moving each boom member by an expansion and contraction hydraulic cylinder (not illustrated). A base end of a base boom member of the boom 9 is swingably supported at substantially a center of the slewing base 7. The expansion and contraction hydraulic cylinder corresponds to an example of an actuator.

The expansion and contraction hydraulic cylinder is telescopically operated by an expansion and contraction valve 32 (see FIG. 2) that is an electromagnetic proportional switching valve. The expansion and contraction valve 32 controls a flow rate of hydraulic oil to be supplied to the expansion and contraction hydraulic cylinder to any flow rate.

That is, the boom 9 is controlled to have any boom length by the expansion and contraction valve 32. The boom 9 has an expansion and contraction sensor 26 and a weight sensor 27 (see FIG. 2). The boom 9 corresponds to an example of a operable function unit. The operable function unit may be regarded as including at least the boom 9.

The expansion and contraction sensor 26 detects a length of the boom 9. The weight sensor 27 detects a weight Wm of the load W to be added to a main hook 10*a*. Alternatively, the weight sensor 27 detects a weight Ws of the load W to be added to a sub hook 11*a*. The weight sensor 27 corresponds to an example of a suspension load detection unit.

The jib 9*a* is used for enlarging a lifting height and a working radius of the crane device 6. The jib 9*a* is held in a posture along the base boom member by a jib support section provided on the base boom member of the boom 9. A base end of the jib 9*a* is configured to be connectable to a jib support section of a top boom member.

The main hook block 10 and the sub hook block 11 are suspending tools for suspending the load W. A plurality of hook sheaves around which the main wire rope 14 is wound and the main hook 10*a* for suspending the load W are provided at the main hook block 10.

The sub hook 11*a* for suspending the load W is provided at the sub hook block 11. A weight of the main hook block 10 may be regarded as a weight including the hook sheaves and the main hook 10*a*. Alternatively, a weight of the sub hook block 11 may be regarded as a weight including the sub hook 11*a*.

The derricking hydraulic cylinder 12 raises and lowers the boom 9 to hold the posture of the boom 9. The derricking hydraulic cylinder 12 has a cylinder section and a rod section. An end portion of the cylinder section is swingably connected to the slewing base 7. An end portion of the rod section is swingably connected to the base boom member of the boom 9. The derricking hydraulic cylinder 12 corresponds to an example of an actuator.

The derricking hydraulic cylinder 12 is telescopically operated by a derricking valve 33 (see FIG. 2) that is an electromagnetic proportional switching valve. The derricking valve 33 can control a flow rate of hydraulic oil to be supplied to the derricking hydraulic cylinder 12 to any flow rate. That is, the boom 9 is controlled by the derricking valve 33 to any derricking speed. A derricking sensor 28 (see FIG. 2) that detects a derricking angle of the boom 9 is provided at the boom 9.

The main winch 13 and the sub winch 15 pull in (wind up) and let out (wind out) the main wire rope 14 and the sub wire rope 16. The main winch 13 has a main drum around which the main wire rope 14 is wound, and a main hydraulic motor (not illustrated) that rotationally drives the main drum. The main hydraulic motor corresponds to an example of an actuator.

The sub winch 15 includes a sub drum around which the sub wire rope 16 is wound, and a sub hydraulic motor (not illustrated) that rotationally drives the sub drum. The sub hydraulic motor corresponds to an example of an actuator.

The main hydraulic motor is rotationally operated by a main valve 34 (see FIG. 2) that is an electromagnetic proportional switching valve. The main valve 34 can control a flow rate of hydraulic oil to be supplied to the main hydraulic motor to any flow rate.

That is, the main winch 13 is controlled by the main valve 31 to have any pulling-in and letting-out speed. Similarly, the sub winch 15 is controlled by a sub valve 35 (see FIG. 2) that is an electromagnetic proportional switching valve to have any pulling-in and letting-out speed.

A main letting-out amount detection sensor 29 is provided at the main winch 13. Similarly, a sub letting-out amount detection sensor 30 is provided at the sub winch 15. The main winch 13 and the sub winch 15 correspond to an example of a operable function unit.

The main letting-out amount detection sensor 29 detects a letting-out amount Lma(n) of the main wire rope 14 let out from the main winch 13. The letting-out amount Lma(n) detected by the main letting-out amount detection sensor 29 may be regarded as a length of the main wire rope 14 let out from the main winch 13.

The sub letting-out amount detection sensor 30 detects a letting-out amount Lsa(n) of the sub wire rope 16 let out from the sub winch 15. The letting-out amount Lsa(n) detected by the sub letting-out amount detection sensor 30 may be regarded as a length of the sub wire rope 16 let out from the sub winch 15.

The cabin 17 covers an operator cab. The cabin 17 is mounted on the slewing base 7. The cabin 17 has the operator cab (not illustrated). An operation tool for operating the vehicle 2 to run and an operation tool for operating the crane device 6 are provided in the operator cab.

Figure 2:
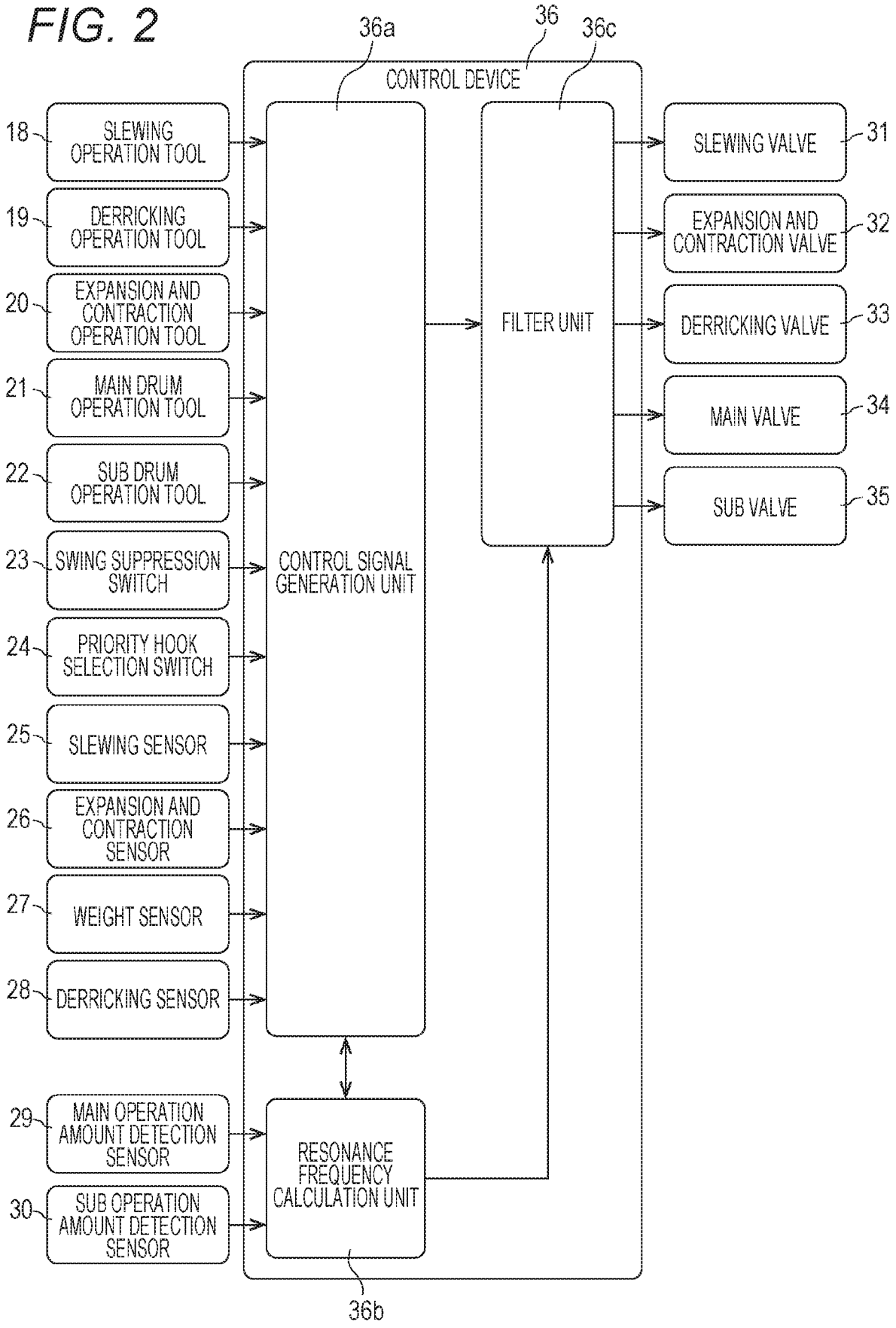
FIG. 2 is a block diagram illustrating a control configuration of the crane.

The operation tool for operating the crane device 6 includes, for example, a slewing operation tool 18, a derricking operation tool 19, an expansion and contraction operation tool 20, a main drum operation tool 21, a sub drum operation tool 22, a swing suppression switch 23, and a priority hook selection switch 24 (see FIG. 2).

Among the operation tools, a tool that receives an operation input for operating the boom 9 corresponds to an example of an operation unit. Specifically, the slewing operation tool 18, the derricking operation tool 19, and the expansion and contraction operation tool 20 correspond to an example of an operation unit. Alternatively, among the operation tools, the main drum operation tool 21 for operating the main winch 13 and the sub drum operation tool 22 for operating the sub winch 15 correspond to an example of an operation unit. Such an operation unit receives an operation input for operating the operable function unit.

The slewing operation tool 18 controls the slewing hydraulic motor 8 by operating the slowing valve 31. The derricking operation tool 19 controls the derricking hydraulic cylinder 12 by operating the derricking valve 33. The expansion and contraction operation tool 20 controls the expansion and contraction hydraulic cylinder by operating the expansion and contraction valve 32.

The main drum operation tool 21 controls the main hydraulic motor by operating the main valve 34. The sub drum operation tool 22 controls the sub hydraulic motor by operating the sub valve 35.

The swing suppression switch 23 is used in selecting whether or not to perform vibration suppression control for unused hooks. In an ON state, the swing suppression switch 23 may automatically determine the unused hook. In the ON state, the swing suppression switch 23 may perform the vibration suppression control on the determined unused hook. In the following description, the hook that suspends the load W is referred to as the used hook. Alternatively, the hook by which the load W is not suspended is called the unused hook.

The priority hook selection switch 24 is used in selecting a hook to which the vibration suppression control is preferentially applied. An operator selects a hook (hereinafter, referred to as a priority hook) to be prioritized from the main hook and the sub hook by operating the priority hook selection switch 24. The priority hook selection switch 24 may be omitted.

When the unused hook is not determinable, a control device 36 may perform the vibration suppression control on the priority hook. The operator may select the unused hook as the priority hook in advance by using the priority hook selection switch 24.

The crane 1 having the aforementioned configuration can move the crane device 6 to any position by causing the vehicle 2 to run. Alternatively, the crane 1 can change the lifting height and the working radius of the crane device 6 by changing the derricking angle of the boom 9 due to the operation of the derricking operation tool 19 and changing the length of the boom 9 due to the operation of the expansion and contraction operation tool 20.

Alternatively, the crane 1 transports the load W by slewing the slewing base 7 due to the operation of the slewing operation tool 18 in a state in which the load W is lifted by operating the drum operation tool (the main drum operation tool 21 or the sub drum operation tool 22) for changing a height of the used hook.

As illustrated in FIG. 2, the control device 36 controls the actuator of the crane 1 via each operation valve. The control device 36 includes a control signal generation unit 36*a*, a resonance frequency calculation unit 36*b*, and a filter unit 36*c*. The control signal generation unit 36*a* corresponds to an example of a generation unit.

The control device 36 is provided in the cabin 17. The control device 36 may actually have a configuration in which a CPU, a ROM, a RAM, and an HDD are connected via a bus. Alternatively, the control device 36 may be configured by a single chip LSI or the like.

The control device 36 may store various kinds of programs and data for controlling operations of the control signal generation unit 36*a*, the resonance frequency calculation unit 36*b*, and the filter unit 36*c*.

The control signal generation unit 36*a* is a part of the control device 36, and generates a control signal that is a speed command for each actuator. The control signal generation unit 36*a* acquires an operation amount (also referred to as operation-related information.) of each operation tool from the slewing operation tool 18, the derricking operation tool 19, the expansion and contraction operation tool 20, the main drum operation tool 21, and/or the sub drum operation tool 22.

The control signal generation unit 36*a* acquires information related to a state of the crane 1 such as the slewing position of the slewing base 7, the boom length, the derricking angle, and/or the weights Wm and Ws of the load W from the slewing sensor 25, the expansion and contraction sensor 26, the weight sensor 27, and/or the derricking sensor 28.

The control signal generation unit 36*a* generates a control signal C(1) of the slewing operation tool 18 based on the acquired operation-related information or the crane 1 and/or the information related to the state of the crane 1. Alternatively, the control signal generation unit 36*a* generates control signals C(2) to C(5) of the operating tools 18 to 22 based on the acquired operation-related information and/or the information related to the state of the crane 1. Hereinafter, the control signals C (1) to C (5) are collectively referred to as a control signal C(n). n may be regarded as the number of operation tools controlled by the control signals generated by the control signal generation unit 36*a*. The control signal C(n) generated by the control signal generation unit 36*a* corresponds to an example of a first control signal.

Alternatively, the control signal generation unit 36*a* may acquire a signal from the swing suppression switch 23. The control signal generation unit 36*a* selects an unused hook, and starts the vibration suppression control. The control signal generation unit 36*a* selects the priority hook to which the vibration suppression control is preferentially applied among the main hook 10*a* and the sub hook 11*a* based on the signal acquired from the priority hook selection switch 24.

The resonance frequency calculation unit 36*b* is a part of the control device 36, and calculates a resonance frequency ω(n) of the swing of the load W by using the load W suspended by the main wire rope 14 and/or the sub wire rope 16 as a simple pendulum. The resonance frequency calculation unit 36*b* corresponds to an example of a calculation unit.

The resonance frequency calculation unit 36*b* may calculate the resonance frequency ω(n) of the swing of the main hook 10*a* by using the main hook 10*a* suspended by the main wire rope 14 as the simple pendulum. Alternatively, the resonance frequency calculation unit 36*b* may calculate the resonance frequency ω(n) of the swing of the sub hook 11*a* by using the sub hook 11*a* suspended by the sub wire rope 16 as the simple pendulum. It may be considered that the resonance frequency calculation unit 36*b* acquires information necessary for calculating the resonance frequency ω(n) from each element constituting the control device 36.

The resonance frequency calculation unit 36*b* may acquire the derricking angle of the boom 9 from the control signal generation unit 36*a*. The resonance frequency calculation unit 36*b* may acquire the letting-out amount Lma(n) of the main wire rope 14 from the main letting-out amount detection sensor 29.

Alternatively, the resonance frequency calculation unit 36*b* may acquire the letting-out amount Lsa(n) of the sub wire rope 16 from the sub letting-out amount detection sensor 30. Alternatively, when the main hook block 10 is used, the resonance frequency calculation unit 36*b* may acquire a winding number of the main hook block 10 from a safety device (not illustrated).

The resonance frequency calculation unit 36*b* calculates a wire length Lm(n) (see FIG. 5) of the main wire rope 14 in a vertical direction from a position at which the main wire rope 14 is separated from the hook sheave (also referred to as a main hook sheave) to the main hook block 10. The resonance frequency calculation unit 36*b* may be regarded as an example of a wire length calculation unit.

The resonance frequency calculation unit 36*b* may calculate the wire length Lm(n) in the vertical direction based on the letting-out amount Lma(n) acquired from the main letting-out amount detection sensor 29. Specifically, the wire length Lm(n) in the vertical direction may be regarded as a value obtained by dividing the letting-out amount Lma(n) by the winding number (two in the case of the present embodiment) of the main hook block 10.

The wire length Lm(n) in the vertical direction may be regarded as the length of the main wire rope 14 equal to a distance between the main hook sheave and the main hook block 10 in the vertical direction.

Alternatively, the resonance frequency calculation unit 36*b* may calculate a wire length Ls(n) (see FIG. 5) of the sub wire rope 16 in the vertical direction from a position at which the sub wire rope 16 is separated from the hook sheave (also referred to as a sub hook sheave) to the sub hook block 11.

The resonance frequency calculation unit 36*b* may calculate the wire length Ls(n) in the vertical direction based on the letting-out amount Lsa(n) acquired from the sub letting-out amount detection sensor 30. In the case of the present embodiment, since the winding number of the sub hook block is one, the wire length Ls(n) in the vertical direction is equal to the letting-out amount Lsa(n).

The wire length Ls(n) in the vertical direction may be regarded as the length of the sub wire rope 16 equal to the distance between the sub hook sheave and the sub hook block 11 in the vertical direction.

The resonance frequency calculation unit 36*b* may calculate the resonance frequency $\omega(n)=\sqrt{(g/L(n))}$ . . . (1) for the main wire rope 14. The resonance frequency calculation unit 36*b* may calculate the resonance frequency $\omega(n)=\sqrt{(g/Lm(n))}$ based on a gravitational acceleration g and the wire length Lm(n) of the main wire rope 14 in the vertical direction.

Alternatively, the resonance frequency calculation unit 36*b* may calculate the resonance frequency $\omega(n)=\sqrt{(g/L(n))}$ . . . (1) for the sub wire rope 16. The resonance frequency calculation unit 36*b* may calculate the resonance frequency $\omega(n)=\sqrt{(g/Ls(n))}$ based on the gravitational acceleration g and the wire length Ls(n) of the sub wire rope 16 in the vertical direction.

The filter unit 36*c* is a part of the control device 36, and generates notch filters F(1)·F(2) . . . F(n) that attenuate a specific frequency region of the control signal C(1)·C(2) . . . C(n) (hereinafter, simply referred to as "notch filters F(n)", where n is any number). The filter unit 36*c* filters the control signal C(n) by the generated notch filter F(n).

The filter unit 36*c* acquires the slewing position of the slewing base 7, the boom length, the derricking angle, the weights Wm and Ws of the load W, the control signal C(1), and the control signal C(2) . . . the control signal C(n) from the control signal generation unit 36*a*. The filter unit 36*c* acquires the resonance frequency ω(n) from the resonance frequency calculation unit 36*b*.

The filter unit 36*c* calculates a center frequency coefficient ωm, a notch width coefficient ζ, and a notch depth coefficient δ of a transfer function H(s) (see Equation (2) below) constituting the notch filter F(n) based on information related to an operation state of the crane 1 such as the acquired slewing position of the slewing base 7, the boom length, the derricking angle, and the weights Wm and Ws of the load W.

The filter unit 36*c* calculates the notch width coefficient ζ and the notch depth coefficient δ corresponding to each control signal C(n). The filter unit 36*c* calculates the corresponding center frequency coefficient on by using the acquired resonance frequency ω(n) as the center frequency ωc(n). In the present embodiment, the filter unit 36*c* calculates the center frequency coefficient ωn, the notch width coefficient ζ, and the notch depth coefficient δ corresponding to the control signal C(n), and applies these coefficients to the transfer function H(s).

The filter unit 36*c* generates a filter control signal Cd(1) obtained by applying the notch filter F(1) to the control signal C(1) and attenuating a frequency component of any frequency range at any ratio by using the resonance frequency ω(1) as a reference from the control signal C(1).

Similarly, the filter unit 36*c* generates the filter control signal Cd(2) by applying the notch filter F(2) to the control signal C(2). That is, the filter unit 36*c* generates a filter control signal Cd(n) (hereinafter, simply referred to as a "filter control signal Cd(n)") obtained by applying the notch filter F(n) to the control signal C(n) and attenuating the frequency component of any frequency range at any ratio by using the resonance frequency ω(n) as a reference from the control signal C(n) The filter control signal Cd(n) generated by the filter unit 36*c* corresponds to an example of a second control signal.

The filter unit 36*c* transfers the filter control signal Cd(n) to the corresponding operation valve among the slewing valve 31, the expansion and contraction valve 32, the derricking, valve 33, the main valve 34, and the sub valve 35.

That is, the control device 36 controls the slewing hydraulic motor 8, the derricking hydraulic cylinder 12, the main hydraulic motor (not illustrated), and the sub hydraulic motor (not illustrated) that are the actuators, via the respective operation valves.

The control signal generation unit 36*a* is connected to the slewing operation tool 18, the derricking operation tool 19, the expansion and contraction operation tool 20, the main drum operation tool 21, and the sub drum operation tool 22. The control signal generation unit 36*a* acquires the respective operation amounts of the slewing operation tool 18, the derricking operation tool 19, the main drum operation tool 21, and the sub drum operation tool 22.

The control signal generation unit 36*a* is connected to the slewing sensor 25, the expansion and contraction sensor 26, the weight sensor 27, and the derricking sensor 28. The control signal generation unit 36*a* acquires the slewing position of the slewing base 7, the boom length, the derricking angle, and the weights Wm and Ws of the load W.

The control signal generation unit 36*a* is connected to the swing suppression switch 23 and the priority hook selection switch 24. The control signal generation unit 36*a* acquires signals from the swing suppression switch 23 and the priority hook selection switch 24.

Alternatively, the control signal generation unit 36*a* is connected to the resonance frequency calculation unit 36*b*. The control signal generation unit 36*a* acquires the letting-out amount Lma(n) of the main wire rope 14 from the resonance frequency calculation unit 36*b*.

Alternatively, the control signal generation unit 36*a* acquires the letting-out amount Lsa(n) of the sub wire rope 16 from the resonance frequency calculation unit 36*b*. Alternatively, the control signal generation unit 36*a* acquires the resonance frequency ω(n) from the resonance frequency calculation unit 36*b*.

The resonance frequency calculation unit 36*b* is connected to the control signal generation unit 36*a*. The resonance frequency calculation unit 36*b* acquires signals from the swing suppression switch 23 and the priority hook selection switch 24. The resonance frequency calculation unit 36*b* is connected to the main letting-out amount detection sensor 29, the sub letting-out amount detection sensor 30, and a safety device (not illustrated). The resonance frequency calculation unit 36*b* calculates the wire length Lm(n) of the main wire rope 14 in the vertical direction and the wire length Ls(n) of the sub wire rope 16 in the vertical direction.

The filter unit 36*c* is connected to the control signal generation unit 36*a*. The filter unit 36*c* acquires filter the slewing position of the slewing base 7, the boom length, the derricking angle, the weights Wm and Ws of the load W, and the control signal C(n). The filter unit 36*c* is connected to the resonance frequency calculation unit 36*b*. The filter unit 36*c* acquires the resonance frequency ω(n) from the resonance frequency calculation unit 36*b*.

The filter unit 36*c* is connected to the slewing valve 31, the expansion and contraction valve 32, the derricking valve 33, the main valve 34, and the sub valve 35. The filter unit 36*c* transfers the filter control signal Cd(n) corresponding to the slewing valve 31, the derricking valve 33, the main valve 34, and the sub valve 35.

Here, the notch filters F(n) will be described with reference to FIGS. 3 and 4. The notch filter F(n) is a filter that gives steep attenuation to the control signal C(n) with any frequency as a center.

Figure 3:
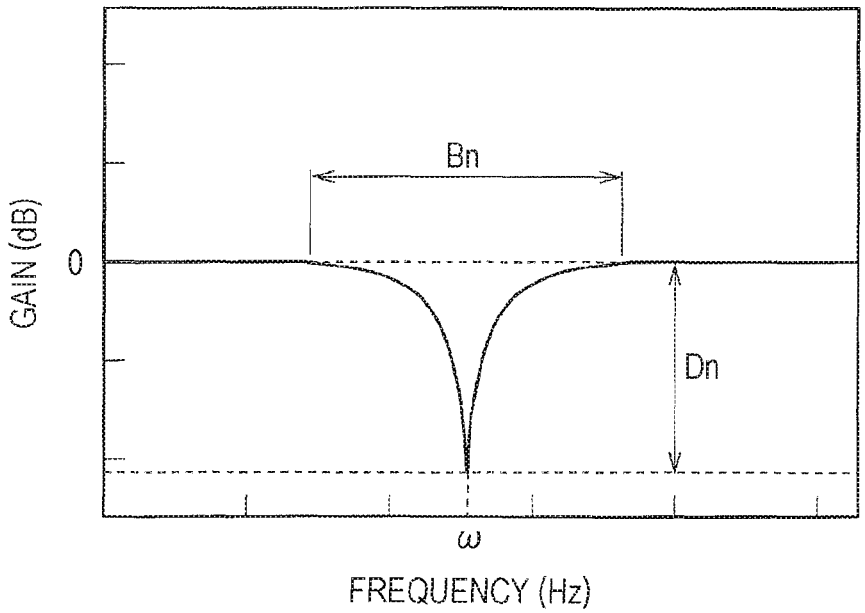
FIG. 3 is a diagram illustrating a graph representing frequency characteristics of a notch filter.

As illustrated in FIG. 3, the notch filter F(n) is a filter having frequency characteristics of attenuating a frequency component with a notch width Bn which is any frequency range with any center frequency ωc(n) as a center at a notch depth Dn that is an attenuation ratio of any frequency in the center frequency ωc(n). That is, the frequency characteristics of the notch filter F(n) are determined by the center frequency ωc(n), the notch width Bn, and the notch depth Dn.

The notch filter F(n) has the transfer function H(s) illustrated in the following Equation (2) below.

[Math. 1]

$$H(s) = \frac{s^2 + 2\delta\zeta\omega_n s + \omega_n^2}{s^2 + 2\zeta\omega_n s + \omega_n^2} \tag{2}$$

In Equation (2), ωn is the center frequency coefficient ωn corresponding to the center frequency ωc(n) of the notch filter F(n). ζ is the notch width coefficient ζ corresponding to the notch width Bn. δ is the notch depth coefficient δ corresponding to the notch depth Dn.

In the notch filter F(n), the center frequency ωc(n) of the notch filter F(n) is changed by changing the center frequency coefficient ωn. Alternatively, in the notch filter F(n), the notch width Bn is changed by changing the notch width coefficient ζ. Alternatively, in the notch filter F(n), the notch depth Dn of the notch filter F(n) is changed by changing the notch depth coefficient δ.

The characteristics of the notch filter F(n) are represented by a load vibration reduction ratio Pnf determined by the notch width coefficient ζ and the notch depth coefficient δ. The load vibration reduction ratio Pnf is a ratio determined by the notch width coefficient ζ and the notch depth coefficient δ in the transfer function H(s) of the notch filter F(n).

In the control signal generation unit 36*a*, the control device 36 having the aforementioned configuration generates the corresponding control signal C(n) of each operation tool based on the operation amounts of the slewing operation tool 18, the derricking operation tool 19, the main drum operation tool 21, and the sub drum operation tool 22.

In the resonance frequency calculation unit 36*b*, the control device 36 calculates the wire length Lm(n) of the main wire rope 14 in the vertical direction based on the letting-out amount Lma(n) of the main wire rope 14 acquired from the main letting-out amount detection sensor 29. Alternatively, in the resonance frequency calculation unit 36*b*, the control device 36 calculates the wire length Ls(n) of the sub wire rope 16 in the vertical direction based on the letting-out amount Lsa(n) of the sub wire rope 16 acquired from the sub letting-out amount detection sensor 30.

In the resonance frequency calculation unit 36*b*, the control device 36 calculates the resonance frequency ω(n) for the main wire rope 14 based on the gravitational acceleration g and the wire length Lm(n) of the main wire rope 14 in the vertical direction. Alternatively, in the resonance frequency calculation unit 36*b*, the control device 36 calculates the resonance frequency ω(n) for the sub wire rope 16 based on the gravitational acceleration g and the wire length Ls(n) of the sub wire rope 16 in the vertical direction.

In the filter unit 36*c*, the control device 36 calculates the notch width coefficient ζ and the notch depth coefficient δ corresponding to the signal C(n) based on the control signal C(n), the swing position of the slewing base 7, the boom length of the boom 9, the derricking angle, and the weights Wm and Ws of the load W. Alternatively, the control device 36 calculates the corresponding center frequency coefficient ωn by using the center frequency ωc(n) having the resonance frequency ω(n) calculated in the resonance frequency calculation unit 36*b* as the reference of the notch filter F(n).

Figure 4:
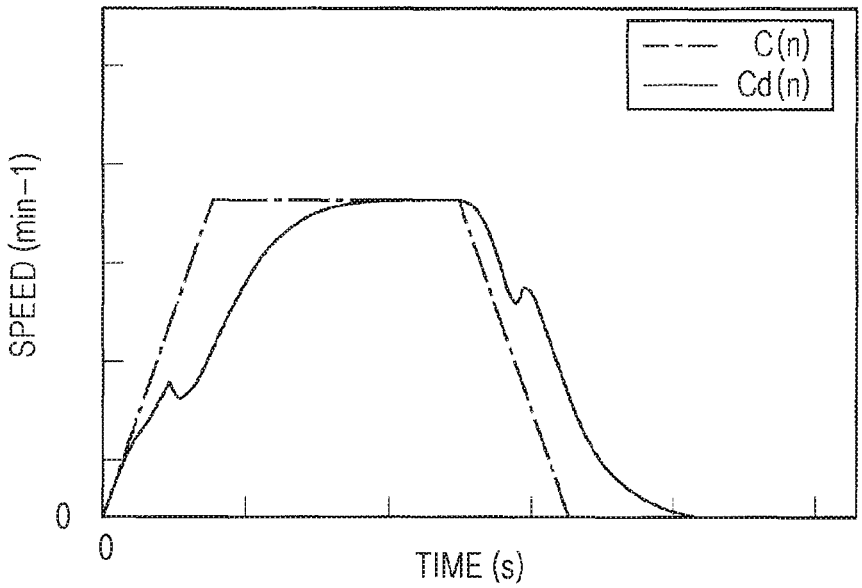
FIG. 4 is a diagram illustrating a graph representing a control signal and a filtering control signal to which the notch filter is applied.

As illustrated in FIG. 4, in the filter unit 36*c*, the control device 36 generates the filter control signal Cd(n) by applying the notch filter F(n) to which the notch width coefficient ζ the notch depth coefficient δ, and the center frequency coefficient ωn are applied, to the control signal C(n).

The filter unit 36*c* transfers the filter control signal Cd(n) to the corresponding operation valve among the slewing valve 31, the expansion and contraction valve 32, the derricking valve 33, the main valve 34, and the sub valve 35, and controls the slewing hydraulic motor 8, the derricking hydraulic cylinder 12, the main hydraulic motor (not illustrated), and the sub hydraulic motor that are the actuators.

Next, the vibration suppression control of the unused hook in the crane 1 will be described. The vibration suppression control of the unused hook automatically detects, as a vibration control target, the unused hook from a plurality of hooks, and performs the vibration suppression control for the unused hook.

In the following embodiments, the control device 36 selects, as the unused hook, any one of the main hook 10*a* and the sub hook 11*a* in the vibration suppression control of the unused hook. That is, the control device 36 may be regarded as having a hook detection unit that selects the unused hook. Alternatively, the control device 36 sets the notch depth coefficient δ and the notch width coefficient ζ to any values corresponding to the operation state of the crane 1.

A first embodiment of the vibration suppression control will be described with reference to FIGS. 5 to 8. The control device 36 detects the unused hook in which the load W is not suspended based on a detection value of the weight sensor 27 (see FIG. 2) and the wire length of the wire rope in the vertical direction.

A reference value Wv is a load that is arbitrarily determined, and is used as a value of reference for regarding that the hook is used. It is preferable that the reference value Wv is a value set such that the vibration suppression control of the unused hook is not stable due to variations in a load. The reference value Wv corresponds to an example of a load threshold value.

The control device 36 detects the hook of the main hook 10*a* and the sub hook 11*a* whose the detection value of the weight sensor 27 (see FIG. 2) is equal to or less than the reference value Wv.

When the wire length of the wire rope in the vertical direction which suspends the detected hook is the smallest among wire lengths of other wire ropes in the vertical direction, the control device 36 sets this hook as the unused hook.

The control device 36 calculates the resonance frequency ω(n) of the unused hook from the wire length of the wire rope of the unused hook in the vertical direction. The control device 36 calculates the notch filter F(n) having the calculated resonance frequency ω(n) as the center frequency ωc(n).

When one operation tool (hereinafter, simply referred to as a "target operation tool") of the slewing operation tool 18, the derricking operation tool 19, the expansion and contraction operation tool 20, the main drum operation tool 21, and the sub drum operation tool 22 is operated, the control device 36 acquires the control signal C(n) generated based on an operation of the target operation tool. The control device 36 generates the filter control signal Cd(n) filtering the acquired control signal C(n) by the notch filter F(n).

The control device 36 controls the corresponding actuator based on the filter control signal Cd(n). Accordingly, the crane 1 suppresses vibration of the unused hook at the resonance frequency ω(n). As a result, it is possible to prevent the unused hook from coming into contact with the wire rope and/or the boom 9 of the used hook due to the vibration of the unused hook during the transportation of the load W.

Hereinafter, the vibration suppression control of the unused hook using the control device 36 will be specifically described with reference to FIGS. 6 to 8. In the following embodiments, it is assumed that the crane 1 is operated by one operation tool.

Figure 6:
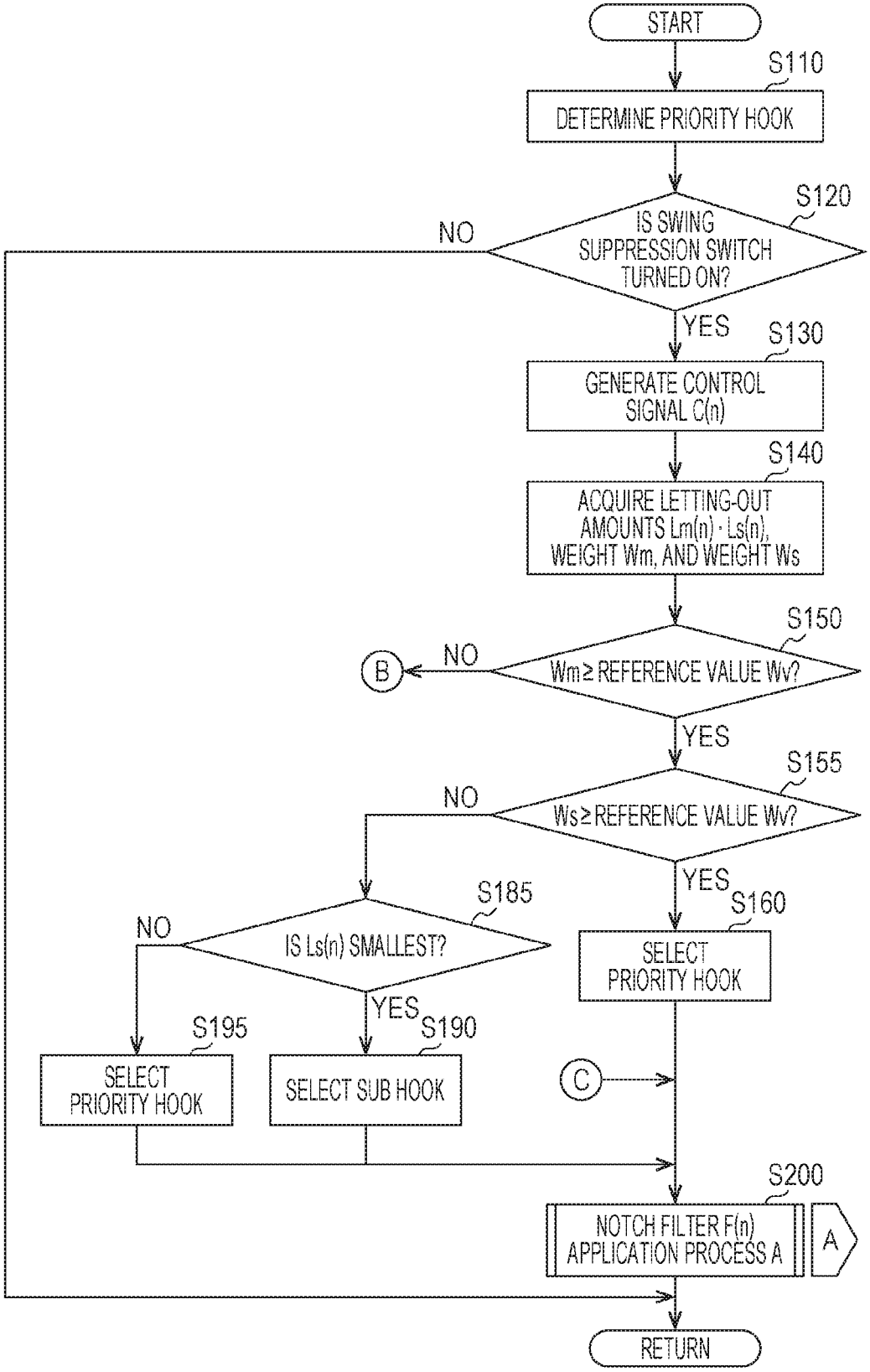
FIG. 6 is a flowchart of a part of vibration suppression control according to a first embodiment of the present invention.

In step S110 of FIG. 6, the control device 36 may determine the priority hook to which the vibration suppression control is preferentially applied based on the operation state of the priority hook selection switch 24. The control device 36 shifts control processing to step S120.

In step S120 of FIG. 6, the control device 36 determines whether or not the swing suppression switch 23 is in the ON state.

When the swing suppression switch 23 is in the ON state ("YES" in step S120), the control device 36 shifts the control processing to step 130.

Meanwhile, when the swing suppression switch 23 is not in the ON state ("NO" in step S120), the control device 36 shifts the control processing to step S110. In step S120, when the swing suppression switch 23 is not in the ON state, the vibration suppression control of the hook (main hook 10*a* in the present embodiment) that suspends the load W may be started. That is, the crane 1 according to the present embodiment may be regarded as having a function of performing the vibration suppression control of the unused hook and a function of performing the vibration suppression control of the used hook.

In step S130 of FIG. 6, the control device 36 generates the control signal C(n) from an operation signal of the one operation tool. The control device 36 shifts the control processing to step S140.

In step S140 of FIG. 6, the control device 36 acquires the weight Wm to be applied to the main hook 10*a* and the weight Ws to be applied to the sub hook 11*a* from the weight sensor 27. Alternatively, in step S140, the control device 36 acquires (calculates) the wire length Lm(n) of the main wire rope 14 in the vertical direction. Alternatively, in step 140, the control device 36 acquires (calculates) the wire length Ls(n) of the sub wire rope 16 in the vertical direction. The control device 36 shifts the control processing to step S150.

In step S150 of FIG. 6, the control device 36 determines whether or not the weight Wm to be app tied to the main hook 10*a* is equal to or greater than the reference value Wv.

When the weight Wm to be applied to the main hook 10*a* is equal to or greater than the reference value Wv in step S150 ("YES" in step S150), the control device 36 shifts the control processing to step S155. When the weight Wm to be applied to the main hook 10*a* is equal to or greater than the reference value Wv, since the load W is suspended, the main hook 10*a* is used.

Figure 8:
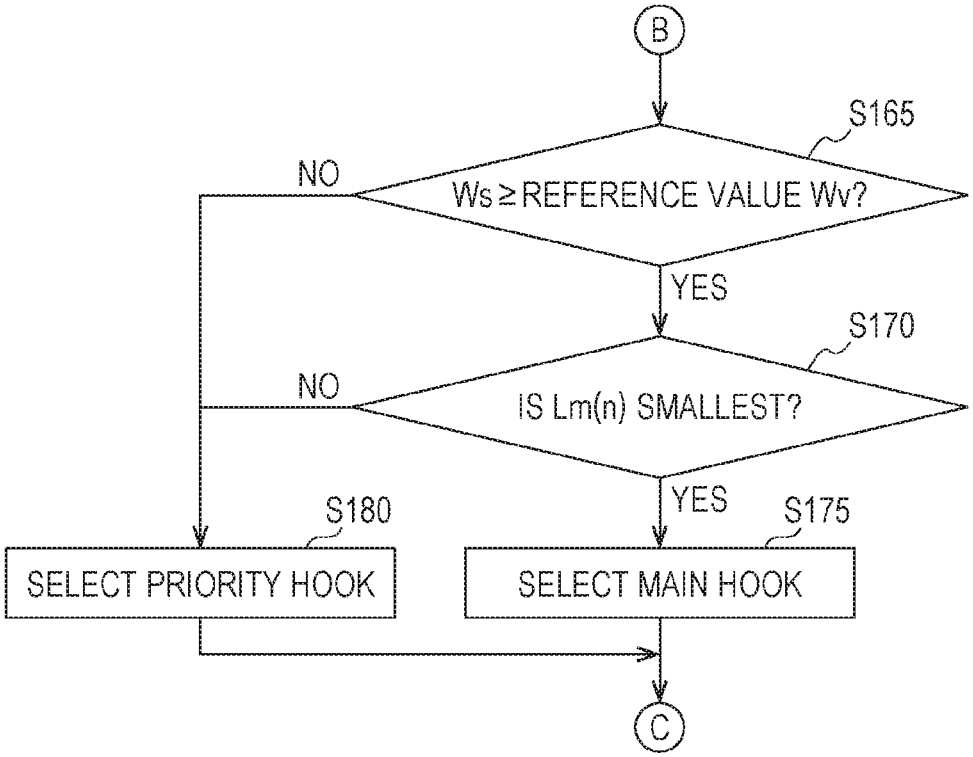
FIG. 8 is a flowchart of a part of the vibration suppression control according to the first embodiment of the present invention.

Meanwhile, when the weight Wm to be applied to the main hook 10*a* is not equal to or greater than the reference value Wv in step S150 ("NO" in step S150), the control device 36 shifts the control processing to step S165 (see a connection symbol B of FIG. 6 to a connection symbol B of FIG. 8). When the weight Wm to be applied to the main hook 10*a* is not equal to or greater than the reference value Wv, since the load W is not suspended by the main hook 10*a*, the main hook 10*a* is not used.

In step S155 of FIG. 6, the control device 36 determines whether or not the weight Ws to be applied to the sub hook 11*a* is equal to or greater than the reference value Wv.

When the weight Ws to be applied to the sub hook 11*a* is equal to or greater than the reference value Wv in step S155 ("YES" in step S155), the control device 36 shifts the control processing to step S160. When the weight Ws to be applied to the sub hook 11*a* is equal to or greater than the reference value Wv, since the load W is suspended by the sub hook 11*a*, the sub hook 11*a* is used.

When the weight Ws to be applied to the sub hook 11*a* is not equal to or greater than the reference value Wv in step S155 ("NO" in step S155), the control device 36 shifts the control processing to step S185. When the weight Ws to be applied to the sub hook 11*a* is not equal to or greater than the reference value Wv in step S155, since the load W is not suspended by the sub hook 11*a*, the sub hook 11*a* is not used.

In step S160 of FIG. 6, the control device 36 selects the priority hook as the hook to which the vibration suppression control is applied. The control device 36 shifts the control processing to step S200.

In step S185 of FIG. 6, the control device 36 determines whether or not the wire length Ls(n) of the sub wire rope 16 in the vertical direction is the smallest among the wire lengths of the other wire ropes in the vertical direction.

When the wire length Ls(n) of the sub wire rope 16 in the vertical direction is the smallest among the wire lengths of other wire ropes in the vertical direction in step S185 ("YES" in step S185), the control device 36 shifts the control processing to step S190.

When the wire length Ls(n) of the sub wire rope 16 in the vertical direction is not the smallest among the wire lengths of the other wire ropes in the vertical direction in step S185 ("NO" in step S185), the control device 36 shifts the control processing to step S195.

In step S190 of FIG. 6, the control device 36 selects the sub hook 11*a* as the unused hook (that is, the hook to which the vibration suppression control is applied). The control device 36 shifts the control processing to step S200.

In step S195 of FIG. 6, the control device 36 selects the priority hook as the hook to which the vibration suppression control is applied. The control device 36 shifts the control processing to step S200.

In step S200 of FIG. 6, the control device 36 starts vibration suppression control process A using the notch filter F(n). The control device 36 shifts the control processing to step S210 (see FIG. 7). When vibration suppression control process A using the notch filter F(n) is completed, the control device 36 shifts the control processing to step S110 (see FIG. 6).

Figure 7:
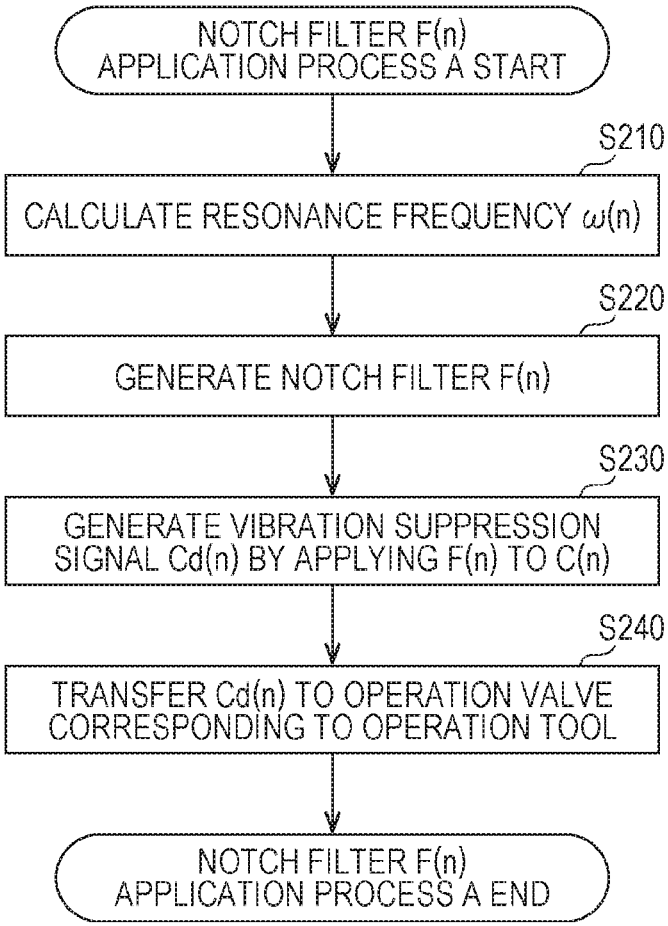
FIG. 7 is a flowchart illustrating a notch filter application process.

FIG. 7 is a flowchart of vibration suppression control process A using the notch filter F(n). In step S210 of FIG. 7, the control device 36 calculates the resonance frequency ω(n) of the target wire rope based on the wire rope (hereinafter, referred to as a wire length of a target wire rope in the vertical direction) of the wire rope in the vertical direction which suspends the hook (hereinafter, referred to as the target hook) selected as the hook to which the vibration suppression control is applied. The control device 36 shifts the control processing to step S220.

When the target hook is the main hook 10*a* in step S210, the target wire rope is the main wire rope 14, and the wire length of the target wire rope in the vertical direction is the wire length Lm(n) of the main wire rope 14 in the vertical direction.

Meanwhile, when the target hook is the sub hook 11*a* in step S210, the target wire rope is the sub wire rope 16, and the wire length of the target wire rope in the vertical direction is the wire length Ls(n) of the sub wire rope 16 in the vertical direction.

In step S220 of FIG. 7, the control device 36 generates the notch filter F(n) by applying the notch width coefficient ζ, the notch depth coefficient δ, and the center frequency coefficient ωn corresponding to the resonance frequency ω(n) calculated according to the operation state of the crane 1 to the transfer function H(s) (see Equation (2)) of the notch filter F(n). The control device 36 shifts the control processing to step S230.

In step S230 of FIG. 7, the control device 36 generates the filter control signal Cd(n) by filtering the generated control signal C(n) by the notch filter F(n). The control device 36 shifts the control processing to step S240.

In step S240 of FIG. 7, the control device 36 transfers the generated filter control signal Cd(n) to the operation valve corresponding to the operation tool. As stated above, the control device 36 controls the actuators (for example, the slewing hydraulic motor 8, the expansion and contraction hydraulic cylinder, and the derricking hydraulic cylinder 12) based on the filter control signal Cd(n).

That is, the control device 36 corresponds to an example of a control unit that controls the actuator based on the second control signal. The control device 36 completes vibration suppression control process A using the notch filter F(n). Thereafter, the control device 36 shifts the control processing to step S110 (see FIG. 6).

FIG. 8 is a flowchart of processing to be performed after shifting from the connection symbol B of FIG. 6. In step S165 of FIG. 8, the control device 36 determines whether or not the weight Ws to be applied to the sub hook 11*a* is equal to or greater than the reference value Wv.

When the weight Ws to be applied to the sub hook 11*a* is equal to or greater than the reference value Wv in step 165 ("YES" in step S165), the control device 36 shifts the control processing to step S170. When the weight Ws to be applied to the sub hook 11*a* is equal to or greater than the reference value Wv in step S165, the sub hook 11*a* is used.

Meanwhile, when the weight Ws to be applied to the sub hook 11*a* is not equal to or greater than the reference value Wv in step S165 ("NO" in step S165), the control device 36 shifts the control processing to step S180. When the weight Ws to be applied to the sub hook 11*a* is not equal to or greater than the reference value Wv in step S165, the sub hook 11*a* is not used.

In step S170 of FIG. 8, the control device 36 determines whether or not the wire length Lm(n) of the main wire rope 14 in the vertical direction is the smallest among the wire lengths of the other wire ropes in the vertical direction.

When the wire length Lm(n) of the main wire rope 14 in the vertical direction is the smallest among the wire lengths of other wire ropes in the vertical direction in step S170 ("YES" in step S170), the control device 36 shifts the control processing to step S175.

Meanwhile, when the wire length Lm(n) of the main wire rope 14 in the vertical direction is not the smallest among the wire lengths of other wire ropes in the vertical direction in step S170 ("NO" in step S170), the control device 36 shifts the control processing to step S180.

In step S175 of FIG. 8, the control device 36 selects the main hook 10*a* as the unused hook (that is, the hook to which the vibration suppression control is applied). The control device 36 shifts the control processing from a connection symbol C of FIG. 6 to step S200 (see FIG. 6).

In step S180 of FIG. 8, the control device 36 selects the priority hook as the hook to which the vibration suppression control is applied. The control device 36 shifts the control processing from the connection symbol C of FIG. 6 to step S200 (see FIG. 6).

As stated above, the crane 1 performs the vibration suppression control corresponding to the operation state of the crane 1 by not only selecting the hook by using the weights Wm and Ws of the load W to be added to each hook as the reference but also automatically selecting the hook that have a small wire length in the vertical direction and is difficult to suppress vibration by a manual operation. Accordingly, the unused hook of the plurality of hooks can transport the load W without coming into contact with the wire rope or the boom 9 corresponding to the used hook due to the vibration.

Next, a second embodiment of the vibration suppression control of the unused hook in the crane 1 will be described with reference to FIGS. 5 and 9.

The control device 36 detects the unused hook based on the wire length of the wire rope in the vertical direction. When a difference L(n) (see FIG. 5) between the wire length Lm(n) of the main wire rope 14 in the vertical direction and the wire length Ls(n) of the sub wire rope 16 in the vertical direction is equal to or greater than a reference value Ld, it is difficult to manually perform the vibration suppression control. Thus, in the case of the present embodiment, the crane 1 automatically selects the unused hook by using a condition in which the difference L(n) is equal to or greater than the reference value Ld as one condition, and performs the vibration suppression control on the selected unused hook. The reference value Ld may be a value that is arbitrarily set as a value for determining whether or not manual vibration suppression control can be performed.

In the following description of the vibration suppression control according to the second embodiment, detailed description of the same control processing as the vibration suppression control according to the first embodiment described with reference to FIGS. 1 to 8 will be omitted. In FIG. 9, the same reference signs as those in FIG. 6 are assigned to the same control processing as the vibration suppression control according to the first embodiment. Hereinafter, the vibration suppression control according to the second embodiment will be described focusing on points different from the vibration suppression control according to the first embodiment.

Figure 5:
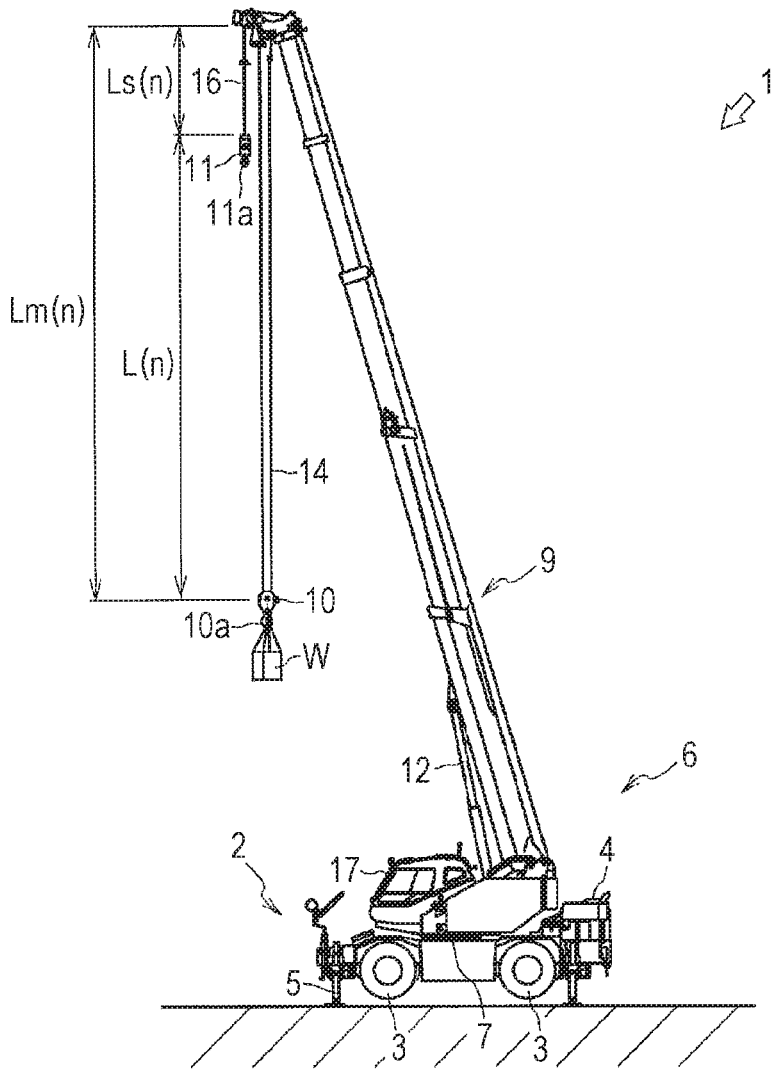
FIG. 5 is a side view of the crane in operation.

As illustrated in FIG. 5, when the difference L(n) between the wire length Lm(n) of the main wire rope 14 in the vertical direction and the wire length Ls(n) of the sub wire rope 16 in the vertical direction is equal to or greater than the reference value Ld, the control device 36 uses, as the unused hook, the hook corresponding to the wire rope of which the wire length in the vertical direction is the smallest among the plurality of wire ropes. The vibration suppression control is performed on the unused hook, and thus, the crane 1 suppresses the vibration of the unused hook at the resonance frequency ω(n). As a result, the unused hook is prevented from coming into contact with the wire rope and/or the boom 9 that suspends the used hook due to the vibration of the unused hook during the transportation of the load W. The reference value Ld corresponds to an example of ae length threshold value.

Hereinafter, the vibration suppression control of the unused hook using the control device 36 according to the second embodiment will be specifically described with reference to FIG. 9. It is assumed that the crane 1 is operated by one operation tool.

Figure 9:
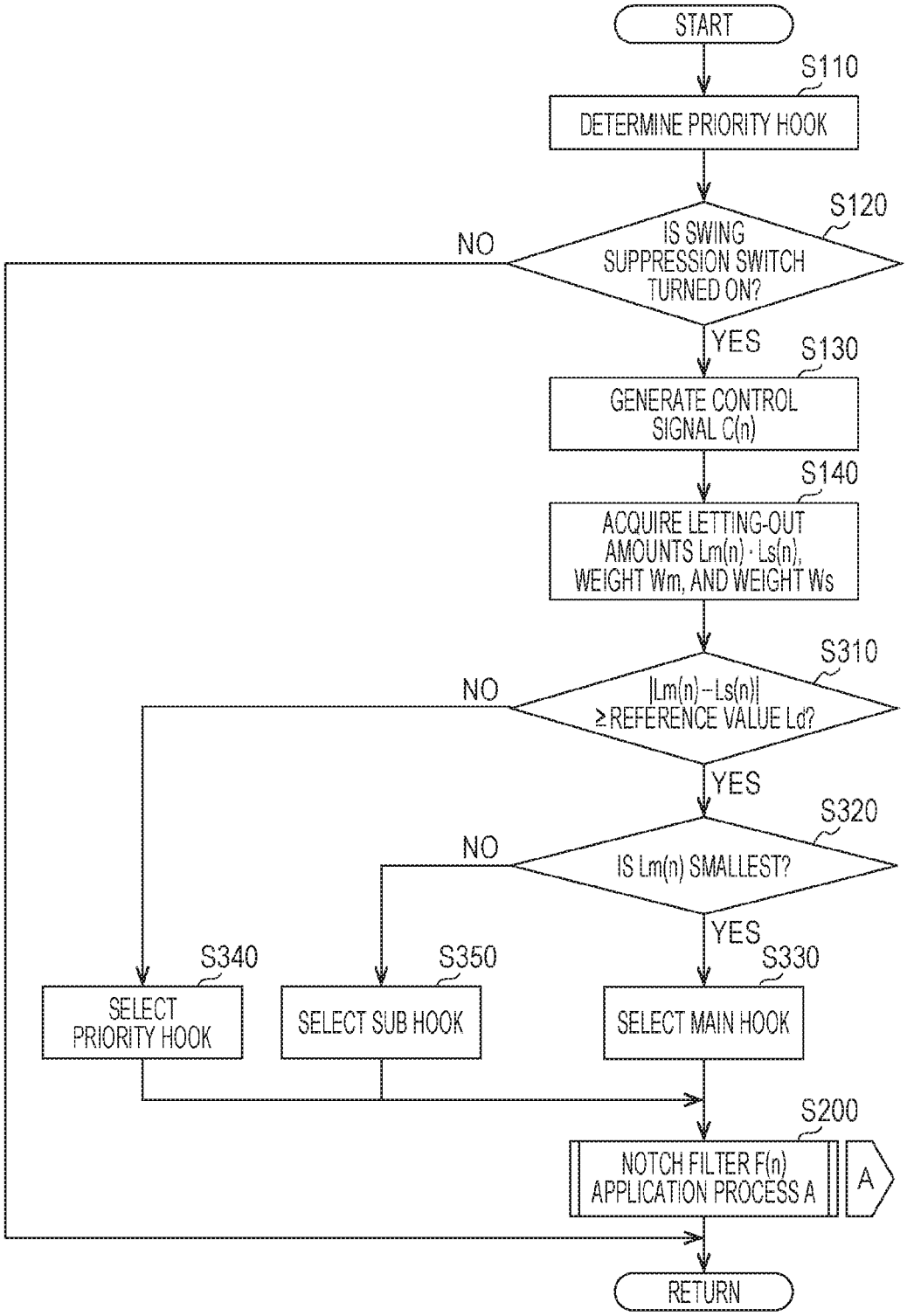
FIG. 9 is a flowchart of a part of vibration suppression control according to a second embodiment of the present invention.

The control processing of steps S110, S120, and S130 of FIG. 9 is the same as the vibration suppression control according to the first embodiment.

In step S140 of FIG. 9, the control device 36 acquires (calculates) the wire length Lm(n) of the main wire rope 14 in the vertical direction. Alternatively, in step S140, the control device 36 acquires (calculates) the wire length Ls(n) of the sub wire rope 16 in the vertical direction. The acquisition method (calculation method) of the wire length Lm(n) in the vertical direction and the wire length Ls(n) in the vertical direction is as described above. Alternatively, in step S140, the control device 36 may acquire the weight Wm to be applied to the main hook 10*a* and the weight Ws to be applied to the sub hook 11*a* from the weight sensor 27. The control device 36 shifts the control processing to step S310.

In step S310 of FIG. 9, the control device 36 determines whether or not the difference L(n) between the wire length Lm(n) of the main wire rope 14 in the vertical direction and the wire length Ls(n) of the sub wire rope 16 in the vertical direction is equal to or greater than the reference value Ld($|Lm(n)-Ls(n)|\geq Ld$).

When the difference L(n) between the wire length. Lm(n) of the main wire rope 14 in the vertical direction and the wire length Ls(n) of the sub wire rope 16 in the vertical direction is equal to or greater than the reference value Ld in step S310 (in step S310, "YES"), the control device 36 shifts the control processing to step S320.

Meanwhile, when the difference L(n) between the wire length Lm(n) of the main wire rope 14 in the vertical direction and the wire length Ls(n) of the sub wire rope 16 in the vertical direction is not equal to or greater than the reference value Ld in step S310 ("NO" in step S310), the control device 36 shifts the control processing to step S340.

In step S320 of FIG. 9, the control device 36 determines whether or not the wire length Lm(n) of the main wire rope 14 in the vertical direction is the smallest among the wire lengths of the other wire ropes in the vertical direction.

When the wire length Lm(n) of the main wire rope 14 in the vertical direction is the smallest among the wire lengths of other wire ropes in the vertical direction in step S320 ("YES" in step S320), the control device 36 shifts the control processing to step S330.

Meanwhile, when the wire length Lm(n) of the main wire rope 14 in the vertical direction is not the smallest among the wire lengths of other wire ropes in the vertical direction in step S320 ("NO" in step S320), the control device 36 shifts the control processing to step S350.

In the case of the present embodiment, when the wire length Lm(n) of the main wire rope 14 in the vertical direction is not the smallest among the wire lengths of the other wire ropes in the vertical direction in step S320, the wire length Ls(n) of the sub wire rope 16 in the vertical direction is the smallest among the wire lengths of other wire ropes in the vertical direction.

In step S330 of FIG. 9, the control device 36 selects the main hook 10*a* as the unused hook (that is, the hook to which the vibration suppression control is applied). The control device 36 shifts the control processing to step S200.

In step S350 of FIG. 9, the control device 36 selects the sub hook 11*a* as the unused hook (the hook to which the vibration suppression control is applied). The control device 36 shifts the control processing to step S200.

In step S340, the control device 36 selects the priority hook as the hook to which the vibration suppression control is applied. The control device 36 shifts the control processing to step S200.

As described above, in the present embodiment, when the difference in the wire length in the vertical direction between the wire ropes that suspend the hooks is equal to or greater than the reference value Ld, the crane 1 automatically selects, as the target hook, the hook whose wire length in the vertical direction is the smallest among the wire lengths of the other wire ropes in the vertical direction. The vibration suppression control corresponding to the operation state of the crane 1 is performed on the target hook. Accordingly, the vibration of the unused hook among the plurality of hooks is suppressed. As a result, the unused hook is prevented from coming into contact with the wire rope and/or the boom 9 that suspends the used hook due to the vibration of the unused hook during the transportation of the load W.

Hereinafter, a third embodiment of the vibration suppression control of the unused hook in the crane 1 will be described with reference to FIGS. 5 and 10. In the present embodiment, the control device 36 detects the unused hook based on the detection value of the weight sensor 27.

Hereinafter, the vibration suppression control of the unused hook using the control device 36 according to the third embodiment will be specifically described with reference to FIG. 10. It is assumed that the crane 1 is operated by one operation tool.

In the following description of the vibration suppression control according to the third embodiment, detailed description of the same control processing as the vibration suppression control according to the first embodiment described with reference to FIGS. 1 to 8 will be omitted. In FIG. 10, the same reference signs as those in FIG. 6 are assigned to the same control processing as the vibration suppression control according to the first embodiment. Hereinafter, the vibration suppression control according to the third embodiment will be described focusing on points different from the vibration suppression control according to the first embodiment.

Figure 10:
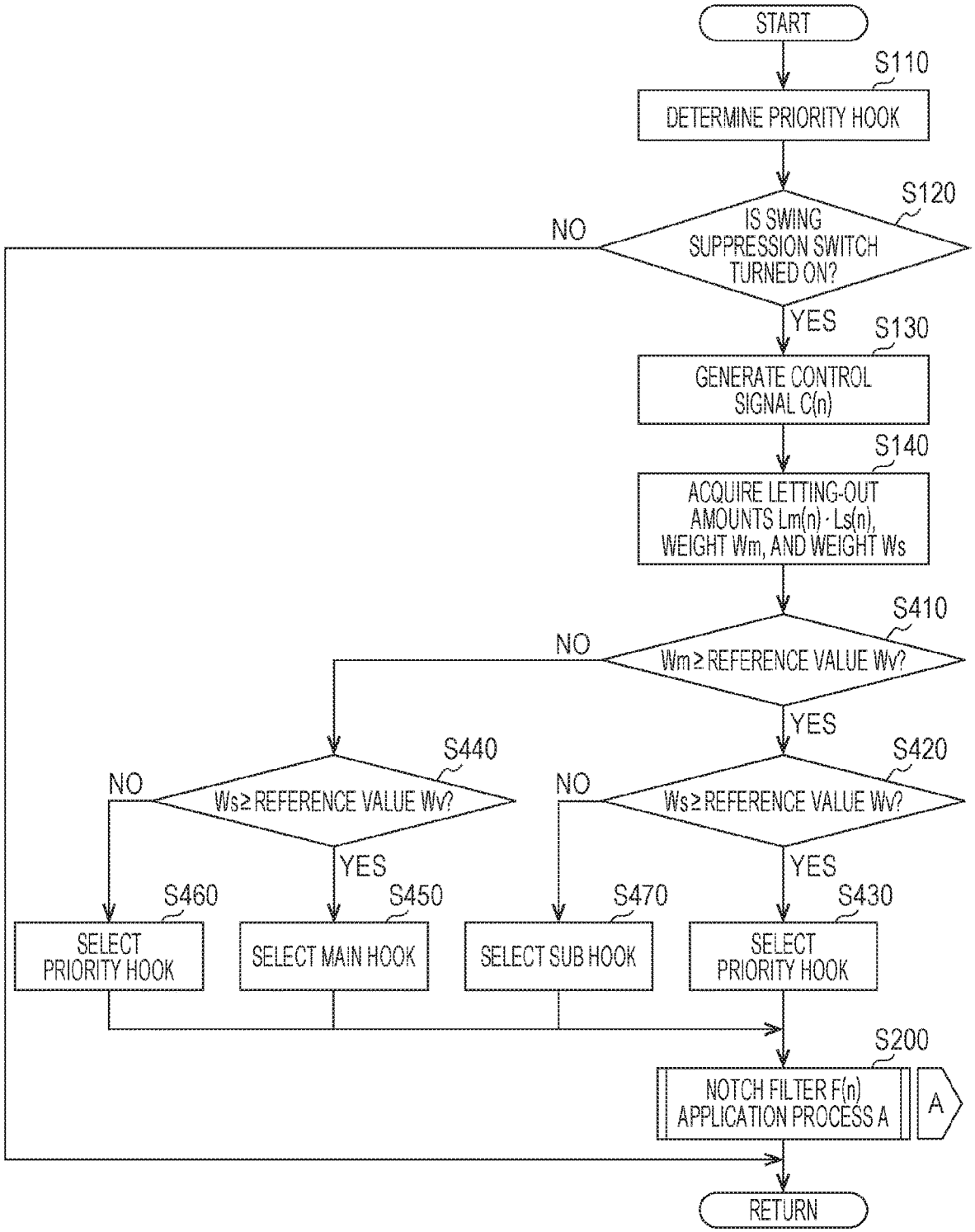
FIG. 10 is a flowchart of a part of vibration suppression control according to a third embodiment of the present invention.

The control processing of step S110, step S120, and step S130 of FIG. 10 is the same as the vibration suppression control according to the first embodiment.

In step S140 of FIG. 10, the control device 36 acquires the weight Wm to be applied to the main hook 10*a* and the weight Ws to be applied to the sub hook 11*a* from the weight sensor 27. Alternatively, in step S140, the control device 36 may acquire (calculate) the wire length Lm(n) of the main wire rope 14 in the vertical direction. Alternatively, in step S140, the control device 36 may acquire (calculate) the wire length Ls(n) of the sub wire rope 16 in the vertical direction. The control device 36 shifts the control processing to step S410.

In step S410 of FIG. 10, the control device 36 determines whether or not the weight Wm to be applied to the main hook 10*a* is equal to or greater than the reference value Wv.

When the weight Wm to be applied to the main hook 10*a* is equal to or greater than the reference value Wv in step S410 ("YES" in step S410), the control device 36 shifts the control processing to step S420. When the weight Wm to be applied to the main hook 10*a* is equal to or greater than the reference value Wv, the main hook 10*a* is used.

Meanwhile, when the weight Wm to be applied to the main hook 10*a* is not equal to or greater than the reference value Wv in step S410 ("NO" in step S410), the control device 36 shifts the control processing to step S440. When the weight Wm to be applied to the main hook 10*a* is not equal to or greater than the reference value Wv, the main hook 10*a* is not used.

In step S420 of FIG. 10, the control device 36 determines whether or not the weight Ws to be applied to the sub hook 11*a* is equal to or greater than the reference value Wv.

When the weight Ws to be applied to the sub hook 11*a* is equal to or greater than the reference value Wv in step S420 ("YES" in step S420), the control device 36 shifts the control processing to step S430. When the weight Ws to be applied to the sub hook 11*a* is equal to or greater than the reference value Wv in step S420, the sub hook 11*a* is used.

Meanwhile, when the weight Ws to be applied to the sub hook 11*a* is not equal to or greater than the reference value Wv in step S420 ("NO" in step S420), the control device 36 shifts the control processing to step S470. When the weight Ws to be applied to the sub hook 11*a* is not equal to or greater than the reference value Wv in step S420, the sub hook 11*a* is not used.

In step S430 of FIG. 10, the control device 36 selects the priority hook as the hook to which the vibration suppression control applied. The control device 36 shifts the control processing to step S200.

In step S470 of FIG. 10, the control device 36 selects the sub hook 11*a* as the unused hook (that is, the hook to which the vibration suppression control is applied). The control device 36 shifts the control processing to step S200.

In step S440 of FIG. 10, the control device 36 determines whether or not the weight Ws to be applied to the sub hook 11*a* is equal to or greater than the reference value Wv.

When the weight Ws to be applied to the sub hook 11*a* is equal to or greater than the reference value Wv in step S440 ("YES" in step S440), the control device 36 shifts the control processing to step S450. When the weight Ws to be applied to the sub hook 11*a* is equal to or greater than the reference value Wv in step S440, the sub hook 11*a* is used.

Meanwhile, when the weight Ws to be applied to the sub hook 11*a* is not equal to or greater than the reference value Wv in step S440 ("NO" in step S440), the control device 36 shifts the control processing to step S460. When the weight Ws to be applied to the sub hook 11*a* is not equal to or greater than the reference value Wv in step S440, the sub hook 11*a* is not used.

In step S450 of FIG. 10, the control device 36 selects the main hook 10*a* as the unused hook (that is, the hook to which the vibration suppression control is applied). The control device 36 shifts the control processing to step S200.

In step S460 of FIG. 10, the control device 36 selects the priority hook as the hook to which the vibration suppression control is applied. The control device 36 shifts the control processing to step S200.

As described above, in the present embodiment, the crane 1 automatically selects the unused hook (target hook) by using the weights Wm and Ws of the load W to be applied to each hook as references. The vibration suppression control corresponding to the operation state of the crane 1 is performed on the target hook. Alternatively, when the unused hook is not selectable, the crane 1 preferentially applies the vibration suppression control to the priority hook determined in advance. That is, the crane 1 selectively applies the vibration suppression control to any one hook of the plurality of hooks. Accordingly, the unused hook is prevented from coming into contact with the wire rope and/or the boom 9 that suspends the used hook due to the vibration of the unused hook during the transportation of the load W.

The aforementioned embodiments may be appropriately combined and implemented within a technically consistent range. Alternatively, although it has been described in the vibration suppression control of the unused hook according to each of the above-described embodiments that the crane 1 attenuates the resonance frequency ω(n) of the control signal C(n) by the notch filter F(n), any filter such as a low-pass filter, a high-pass filter, or a band-stop filter that attenuates a specific frequency may be used. Alternatively, in the vibration suppression control of the unused hook according to the present embodiment, the crane 1 may be configured to control not to apply the notch filter F(n) when the priority hook is selected.

Alternatively, in the control device 36, means for determining the unused hook is not limited to the aforementioned means. For example, a worker may detect, as the unused hook, a hook specified by specification means provided at the crane 1. The specification means may be the priority hook selection switch 24.

Alternatively, the control device 36 may determine the unused hook, for example, based on data captured by a camera provided at the crane 1 (specifically, the leading end section of the boom 9). Such a camera may be provided such that the main hook 10*a* and the sub hook 11*a* can be simultaneously captured. In addition, the control device 36 may detect the unused hook based on information acquired from various detection devices provided at the crane 1.

The aforementioned embodiments merely illustrate examples of a representative embodiment, and can be implemented by being variously modified without departing from the gist of one embodiment. Alternatively, the technical scope of the present invention is indicated by the description of the claims. The technical scope of the present invention also includes inventions having an equivalent relationship with the inventions described in the claims.

The disclosure of Japanese Patent Application. No. 2018-050258 filed on Mar. 16, 2018 including the specification, drawings and abstract is incorporated herein by reference in its entirety.

REFERENCE SIGNS LIST

1 crane
11*a* sub hook
12 derricking hydraulic cylinder
13 main winch
14 main wire rope
15 sub winch
16 sub wire rope
17 cabin
18 slewing operation tool
19 derricking operation tool
2 vehicle
20 expansion and contraction operation tool
21 main drum operation tool
22 sub drum operation tool
23 swing suppression switch
24 priority hook selection switch
25 slewing sensor
26 expansion and contraction sensor
27 weight sensor
28 derricking sensor
29 main letting-out amount detection sensor
3 wheel
30 sub letting-out amount detection sensor
31 slewing valve
32 expansion and contraction valve
33 derricking valve
34 main valve
35 sub valve
36 control device
36*a* control signal generation unit
36*b* resonance frequency calculation unit
36*c* filter unit
4 engine
5 outrigger
6 crane device
7 slewing base
8 slewing hydraulic motor
9 boom
9*a* jib

The invention claimed is:

1. A crane comprising:
a operable function unit including at least a boom;
an operation unit that receives an operation input for operating the operable function unit;
an actuator that drives the operable function unit;
a generation unit that generates a first control signal of the actuator based on the operation input;
a plurality of wire ropes;
a plurality of hooks that is suspended from a leading end section of the boom by the plurality of wire ropes, respectively;
a hook detection unit that detects an unused hook which does not suspend a load among the plurality of hooks;
a calculation unit that calculates a resonance frequency for the wire rope suspending the detected unused hook among the plurality of wire ropes;
a filter unit that generates a filter based on the resonance frequency, and generates a second control signal by filtering the first control signal due to use of the filter; and
a control unit that controls the actuator based on the second control signal.

2. The crane according to claim 1, further comprising:
a load detection unit that detects loads acting on the plurality of hooks,
wherein the hook detection unit detects the unused hook based on the detected loads.

3. The crane according to claim 2,
wherein the hook detection unit uses, as the unused hook, the hook whose detected load is the smallest among the plurality of hooks.

4. The crane according to claim 2, further comprising:
a wire length calculation unit that calculates a length of a portion of each of the plurality of wire ropes which is suspended from the leading end section of the boom in a vertical direction,
wherein the hook detection unit uses, as the unused hook, the hook whose detected load is equal to or less than a load threshold value and is suspended by the wire rope of which the length in the vertical direction is the smallest among the plurality of hooks.

5. The crane according to claim 1, further comprising:
a wire length calculation unit that calculates a length of a portion of each of the plurality of wire ropes which is suspended from the leading end section of the boom in the vertical direction,
wherein the hook detection unit detects the unused hook based on the calculated length in the vertical direction.

6. The crane according to claim 5, wherein the hook detection unit uses, as the unused hook, the hook suspended by the wire rope of which the length in the vertical direction is the smallest among the plurality of wire ropes.

7. The crane according to claim 5, wherein, when a difference between a length of a first wire rope, which is the wire rope whose length in the vertical direction is the longest, in the vertical direction and a length of a second wire rope, which is the wire rope whose length in the vertical direction is the smallest, in the vertical direction is equal to or greater than a length threshold value, the hook detection unit uses, as the unused hook, the hook suspended by the second wire rope.

8. The crane according to claim 1, wherein the actuator includes at least one actuator of an expansion and contraction actuator for expanding and contracting the boom, a derricking actuator for derricking the boom, and a slewing actuator for slewing the boom.

9. The crane according to claim 1, wherein the operable function unit includes a plurality of winches that is provided so as to correspond to the plurality of wire ropes, respectively, and lets out and pulls in the corresponding wire ropes, respectively, and the actuator includes a plurality of winch actuators that is provided so as to correspond to the plurality of winches, respectively, and drives the corresponding winches, respectively.

10. The crane according to claim 1, wherein the filter has a function of attenuating a frequency component of a predetermined frequency range using the resonance frequency as a reference at a predetermined ratio from the first control signal.

* * * * *